US007832365B2

(12) United States Patent
Hannum et al.

(10) Patent No.: US 7,832,365 B2
(45) Date of Patent: Nov. 16, 2010

(54) SUBMERGED COMBUSTION VAPORIZER WITH LOW NOX

(75) Inventors: Mark C. Hannum, Aurora, OH (US); Thomas F. Robertson, Medina Township, OH (US); John N. Newby, Lexington, KY (US); John J. Nowakowski, Valley View, OH (US)

(73) Assignee: Fives North American Combustion, Inc., Cleveland, OH (US)

( * ) Notice: Subject to any disclaimer, the term of this patent is extended or adjusted under 35 U.S.C. 154(b) by 463 days.

(21) Appl. No.: 11/514,635

(22) Filed: Sep. 1, 2006

(65) Prior Publication Data

US 2007/0062197 A1 Mar. 22, 2007

Related U.S. Application Data

(60) Provisional application No. 60/714,569, filed on Sep. 7, 2005.

(51) Int. Cl.
*F17C 9/02* (2006.01)

(52) U.S. Cl. ..... 122/31.2; 62/50.2

(58) Field of Classification Search ..... 122/31.2, 122/31.1, 33; 126/367.1, 368.1, 360.2; 62/50.2; 60/737

See application file for complete search history.

(56) References Cited

U.S. PATENT DOCUMENTS 1,599,015 A 9/1926 Jackson et al.
3,998,581 A 12/1976 Hemingway et al.
4,377,133 A * 3/1983 Mankekar ..... 122/31.2
4,395,223 A 7/1983 Okigami et al.
4,618,323 A 10/1986 Mansour
5,032,230 A 7/1991 Shepherd
5,186,617 A 2/1993 Ho
5,201,650 A 4/1993 Johnson
5,381,742 A * 1/1995 Linton et al. ..... 110/238
5,462,430 A 10/1995 Khinkis
5,482,457 A 1/1996 Aigner et al.
5,511,970 A 4/1996 Irwin et al.
5,575,146 A 11/1996 Borkowicz et al.
5,584,684 A 12/1996 Dobbeling et al.
5,645,410 A 7/1997 Brostmeyer
5,667,376 A 9/1997 Robertson et al.
5,756,059 A 5/1998 Zamansky et al.
5,799,620 A * 9/1998 Cleer et al. ..... 122/31.2
6,045,351 A 4/2000 Dobbeling et al.
6,089,855 A 7/2000 Becker et al.
6,132,202 A 10/2000 Eroglu et al.

(Continued)

OTHER PUBLICATIONS

Cain et al., "Reducing Nox Emissions in High-Temperature Furnaces", The North American Manufacturing Company, USA, (undated) 18 pages.

(Continued)

*Primary Examiner*—Gregory A Wilson
(74) *Attorney, Agent, or Firm*—Jones Day

(57) ABSTRACT

A submerged combustion vaporizer may include a premix burner with multiple integral mixers for forming premix and discharging the premix into the duct system that communicates the burner with the sparger tubes. The SCV may further include a NOx suppression system that injects a staged fuel stream into the exhaust in the duct system, and/or a NOx suppression system that mixes water with the premix.

19 Claims, 9 Drawing Sheets

U.S. PATENT DOCUMENTS

| | | | | |
|---|---|---|---|---|
| 6,200,476 | B1 | 3/2001 | Donath et al. | |
| 6,422,858 | B1 | 7/2002 | Chung et al. | |
| 6,638,061 | B1 | 10/2003 | Cain et al. | |
| 6,705,855 | B2 | 3/2004 | Nagayama et al. | |
| 6,736,129 | B1 * | 5/2004 | Smith | 126/343.5 R |
| 6,769,903 | B2 | 8/2004 | Eroglu et al. | |
| 6,773,256 | B2 | 8/2004 | Joshi et al. | |
| 6,971,336 | B1 * | 12/2005 | Chojnacki et al. | 122/149 |
| 7,383,779 | B2 * | 6/2008 | Broussard | 110/346 |
| 7,540,160 | B2 * | 6/2009 | Rost et al. | 62/50.2 |
| 2006/0183064 | A1 * | 8/2006 | Rost et al. | 431/11 |
| 2006/0240370 | A1 | 10/2006 | Neville et al. | |
| 2007/0062197 | A1 * | 3/2007 | Hannum et al. | 60/737 |

OTHER PUBLICATIONS

Robertson, et al., "Application of a Novel Lox Nox Combustion System to an Oil Field Steam Generator", Society of Petroleum Engineers, SPE 30266, 1995, 16 pages.

International Search Report and Written Opinion of the International Searching Authority for PCT/US06/34658, dated Jul. 23, 2007.

* cited by examiner

SUBMERGED COMBUSTION VAPORIZER WITH LOW NOX

CROSS-REFERENCE TO RELATED APPLICATIONS

This application claims the benefit of provisional U.S. patent application 60/714,569, filed Sep. 7, 2005, which is incorporated by reference.

TECHNICAL FIELD

This technology relates to a submerged combustion vaporizer for heating cryogenic fluid.

BACKGROUND

Cryogenic fluid, such as liquefied natural gas, can be heated in a submerged combustion vaporizer (SCV). The SCV includes heat exchanger tubing and a water tank in which the tubing is submerged. The cryogenic fluid flows through the tubing. The SCV further includes a burner that fires into a duct system. The duct system has perforated sections, known as sparger tubes, that direct the burner exhaust to bubble upward through the water in the tank. The exhaust then heats the water and the submerged tubing so that the cryogenic fluid flowing through the tubing also becomes heated. Nitrogen oxides (NOx) in the exhaust are carried upward from the tank through a flue and discharged into the atmosphere with the exhaust.

SUMMARY

An SCV may have a system for suppressing NOx by injecting a staged fuel stream into the exhaust in the duct system that extends from the burner to the sparger tubes. The burner may include multiple integral mixers for forming premix and discharging the premix into the duct system. In that case the SCV may have a system for suppressing NOx by mixing water into the premix. These NOx suppression systems enable NOx to be maintained at low levels in the exhaust. The claimed invention also provides a method of suppressing NOx in an SCV by injecting a staged fuel stream into the exhaust in the duct system and/or by mixing water into the premix, as well as a method of retrofitting an SCV by installing the NOx suppression systems.

DETAILED DESCRIPTION

Figure 1:
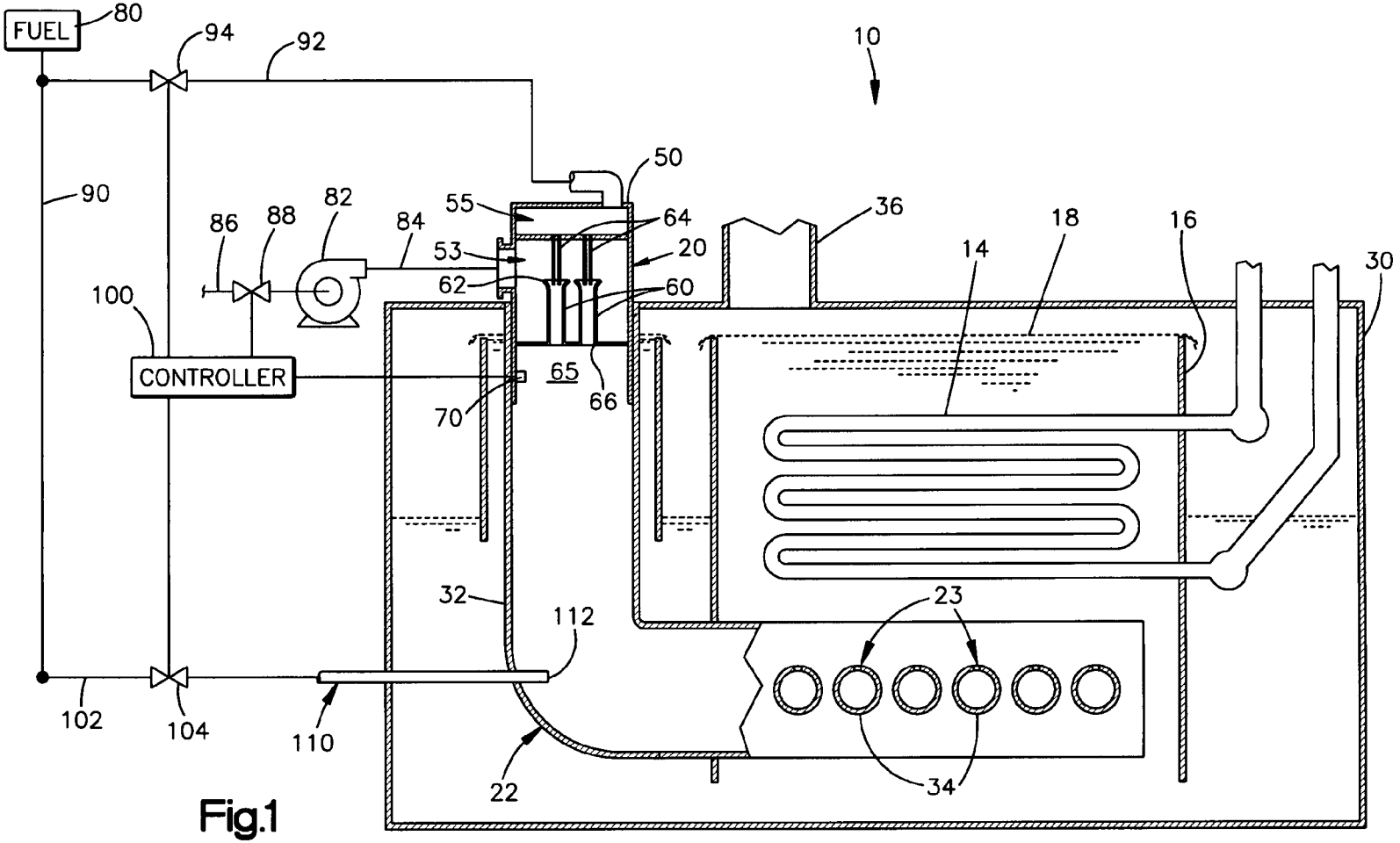
FIG. 1 is a schematic view of an SCV with a staged fuel injector structure.

The structures shown schematically in the drawings have parts that are examples of the elements recited in the apparatus claims, and can be operated in steps that are examples of the elements recited in the method claims. The illustrated structures thus include examples of how a person of ordinary skill in the art can make and use the claimed invention. They are described here to provide enablement and best mode without imposing limitations that are not recited in the claims. The various parts of the illustrated structures, as shown, described, and claimed, may be of either original and/or retrofitted construction as required to accomplish any particular implementation of the invention.

The structure shown schematically in FIG. 1 includes a submerged combustion vaporizer 10 for heating cryogenic fluid. The parts of the SCV 10 that are shown in FIG. 1 include heat exchanger tubing 14 in which the cryogenic fluid flows through the SCV 10. Also shown is a tank structure 16 containing a water bath 18 for the tubing 14. A burner 20 is operative to fire into a duct system 22 that extends into the water bath 18. Outlet ports 23 in the duct system 22 direct exhaust from the burner 20 to bubble upward through the water bath 18. This heats the water bath 18 which, in turn, heats the tubing 14 and the cryogenic fluid flowing through the tubing 14.

Figure 2:
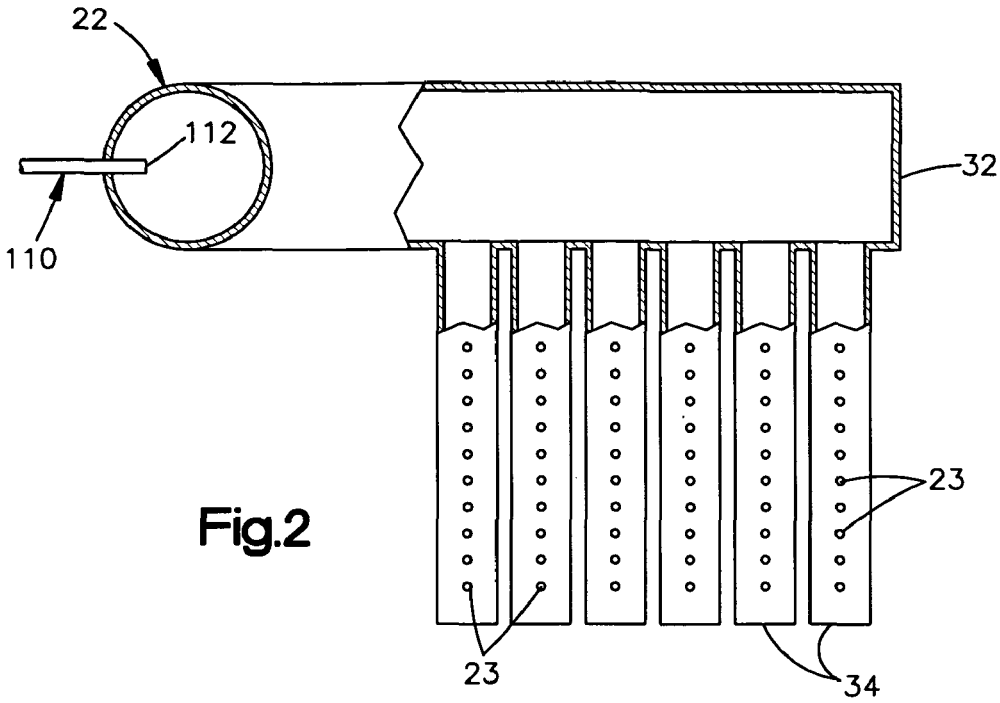
FIG. 2 is a schematic view, taken from above, of parts shown in FIG. 1.

A housing 30 encloses the tank structure 16. The duct system 22 includes a duct 32 that extends within the housing 30 from the burner 20 to a location beneath the tubing 14. The duct system 20 further includes an array of sparger tubes 34. The outlet ports 23 are located on the sparger tubes 34 and, as best shown in FIG. 2, the sparger tubes 34 project from the duct 32 so that the outlet ports 23 are arranged in a wide array beneath the tubing 14. A flue 36 at the top of the housing 30 receives the burner exhaust that emerges from the water bath 18 above the tubing 14.

The burner 20 in the illustrated example is a water cooled premix burner that is free of refractory material. The burner 20 has a housing 50 defining an oxidant plenum 53 and a fuel plenum 55. A plurality of mixer tubes 60, two of which are shown in the schematic view of FIG. 1, are arranged within the oxidant plenum 53. Each mixer tube 60 has an open inner end 62 that receives a stream of oxidant directly from within the oxidant plenum 53. Each mixer tube 60 also receives streams of fuel from fuel conduits 64 that extend from the fuel plenum 55 into the mixer tubes 60. The streams of fuel and oxidant flow through the mixer tubes 60 to form a combustible mixture known as premix.

The premix is ignited in a reaction zone 65 upon emerging from the open outer ends 66 of the mixer tubes 60. Ignition is initially accomplished by the use of an ignition source 70 before the reaction zone 65 reaches the auto-ignition temperature of the premix. Combustion proceeds with a flame that projects from the ends 66 of the mixer tubes 60 into the reaction zone 65. The burner exhaust, including products of combustion for heating the fluid in the tubing 14, then flows through the duct system 22 from the reaction zone 65 to the ports 23 at the sparger tubes 34.

A fuel source 80, which is preferably a supply of natural gas, and an oxidant source 82, which is preferably an air blower, provide the burner 20 with streams of those reactants. The blower 82 supplies combustion air to the oxidant plenum 53 through a duct 84 that extends from the blower 82 to the burner 20. The blower 82 receives combustion air from the ambient atmosphere through a duct 86 with an oxidant control valve 88. The fuel plenum 55 receives fuel from the source 80 through a main fuel line 90 and a primary branch line 92 with a fuel control valve 94.

A controller 100 is operatively associated with the valves 88 and 94. The controller 100 has hardware and/or software that is configured for operation of the SCV 10, and may comprise any suitable programmable logic controller or other control device, or combination of control devices, that is programmed or otherwise configured to perform as recited in the claims. As the controller 100 carries out those instructions, it actuates the valves 88 and 94 to initiate, regulate, and terminate flows of reactant streams that cause the burner 20 to fire into the duct system 22 as described above.

A secondary branch line 102 also extends from the main fuel line 90. The secondary branch line 102 has a fuel control valve 104, and communicates the main line 90 with a staged fuel injector structure 110. The staged fuel injector structure 110 has a fuel injection port 112 arranged to inject a secondary fuel stream directly into the duct 32.

In addition to being operatively associated with the fuel control valve 94 in the primary branch line 92, the controller 100 is operatively associated with the fuel control valve 104 in the secondary branch line 102. Accordingly, in operation of the SCV 10, the controller 100 provides the burner 20 with oxidant and primary fuel streams for combustion in a primary stage, and also provides the duct system 22 with a staged fuel stream for combustion in a secondary stage. The secondary combustion stage occurs when the staged fuel stream forms a combustible mixture and auto-ignites in the exhaust flowing through the duct 32 toward the sparger tubes 34.

Staging the injection of fuel can help to maintain a low level of NOx in the exhaust discharged from the flue 36. This is because the combustible mixture of post-primary fuel and oxidant that forms in the duct system 22 is diluted by the burner output gases before it reaches an auto-ignition temperature. When the diluted mixture ignites upon reaching the auto-ignition temperature, the diluent absorbs heat and thus suppresses the flame temperature. The lower flame temperature results in a correspondingly lower production of NOx.

Figure 3:
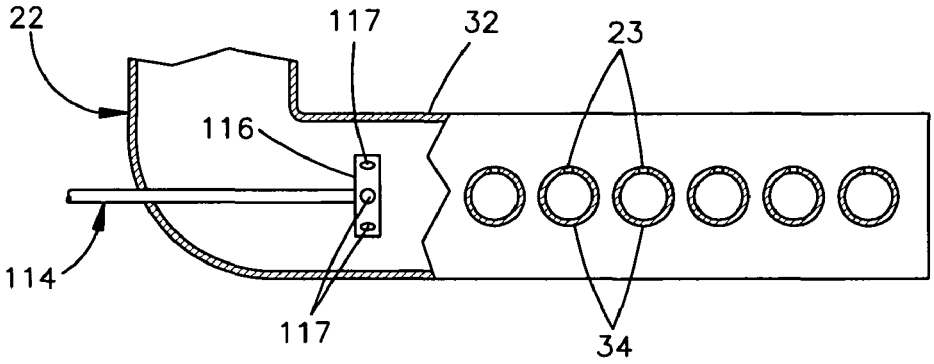
FIG. 3 is a schematic view of a different example of a staged fuel injector structure.

In the example shown in FIGS. 1 and 2, the staged fuel injector structure 110 has a single fuel injection port 112 that injects a single staged fuel stream directly into the duct 32. A different example of a staged fuel injector structure 114 is shown schematically in FIG. 3. This staged fuel injector structure 114 differs from the staged fuel injector structure 110 of FIG. 1 by including a manifold 116 with multiple fuel injection ports 117 to inject multiple staged fuel streams directly into the duct 32. Although this particular example of a manifold is configured to direct fuel streams radially outward, an alternative manifold could be configured to direct fuel streams into the duct 32 in other directions. As in the first example, the controller 100 is preferably configured to actuate the valves 88, 94 and 104 (FIG. 1) such that secondary combustion downstream of the manifold 116 is fuel-lean.

Figure 4:
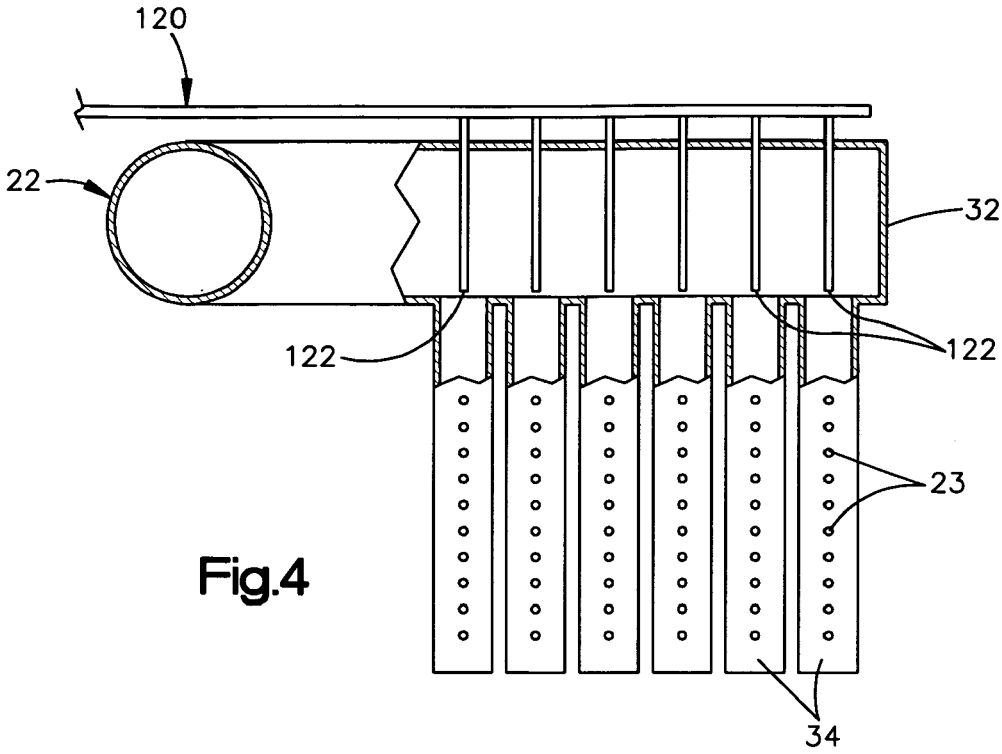
FIG. 4 is a schematic view of another example of a staged fuel injector structure.

FIG. 4 shows another example of a staged fuel injector structure 120 with multiple fuel injection ports 122. Those fuel injection ports 122 correspond to the sparger tubes 34, and are arranged to inject respective fuel streams directly into the sparger tubes 34. More specifically, the staged fuel injector structure 120 is configured to inject a single staged fuel stream directly into each sparger tube 34 at a location upstream of the outlet ports 23 in the sparger tube 34. Secondary combustion stages, which are preferably fuel-lean, then occur substantially simultaneously throughout the sparger tubes 34 upon mixing and auto-ignition of the staged fuel streams with the exhaust flowing through the sparger tubes 34.

Figure 5:
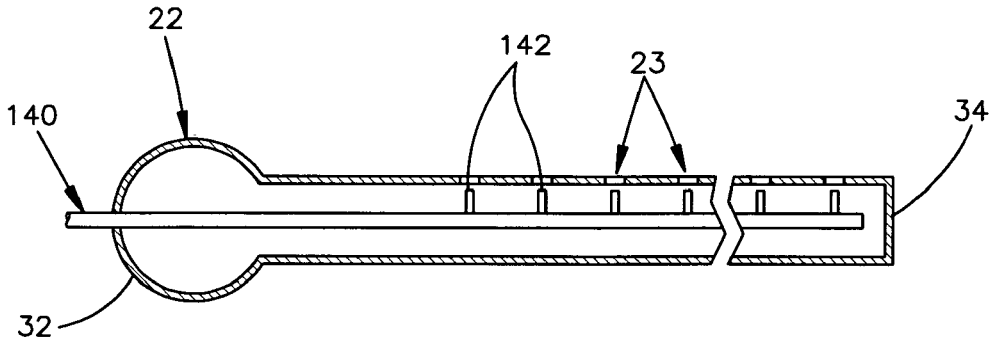
FIG. 5 is a schematic view of yet another example of a staged fuel injector structure.

In another example, a staged fuel injector structure 140 is configured to extend farther than the structure 120 of FIG. 4, and thereby to extend into each sparger tube 34. This is shown partially in FIG. 5 with reference to one of the sparger tubes 34. This staged fuel injector structure 140 has an array of fuel injection ports 142 corresponding to the array of outlet ports 23 in the sparger tubes 34, and is thus configured to inject a plurality of staged fuel streams directly into each sparger tube 34 at locations adjacent to the outlet ports 23 in the sparger tube 34. Secondary combustion, which again is preferred to be fuel-lean, then proceeds as the staged fuel streams form combustible mixtures and auto-ignite in the exhaust that bubbles upward through the water bath 18.

Figure 6:
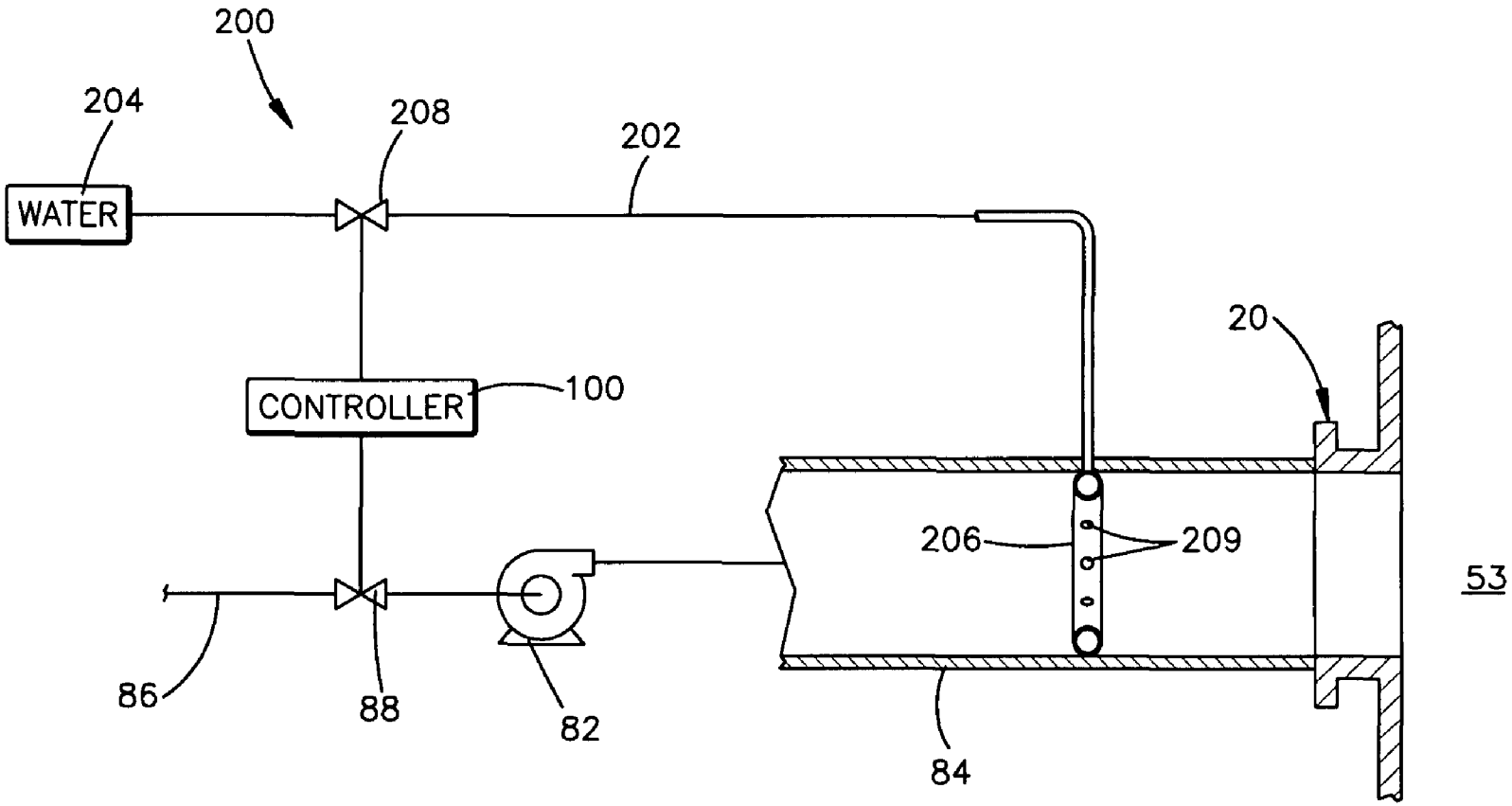
FIG. 6 is a schematic of a water injection system for the SCV of FIG. 1.

As shown partially in FIG. 6, the SCV 10 may include a water injection system 200. This system 200 includes a water line 202 that communicates a water source 204 with a manifold 206. The water source 204 is preferably the tank 16, but could be the publicly available water supply. The manifold 206 in this particular example is located within the oxidant duct 84 that extends from the blower 82 to the burner 20, and is shaped as a ring with an array of ports 209 for injecting streams of water directly into the duct 84. The manifold 206 is thus arranged for the streams of water to enter the oxidant flow path at locations upstream of the oxidant plenum 53 in the burner 20. The controller 100 operates a valve 208 in the water line 202 such that the premix formed in the burner 20 becomes diluted first by the water, and subsequently by the resulting steam, to suppress the production of NOx by suppressing the flame temperature at which the premix combusts in the reaction zone 65 (FIG. 1).

Figure 7:
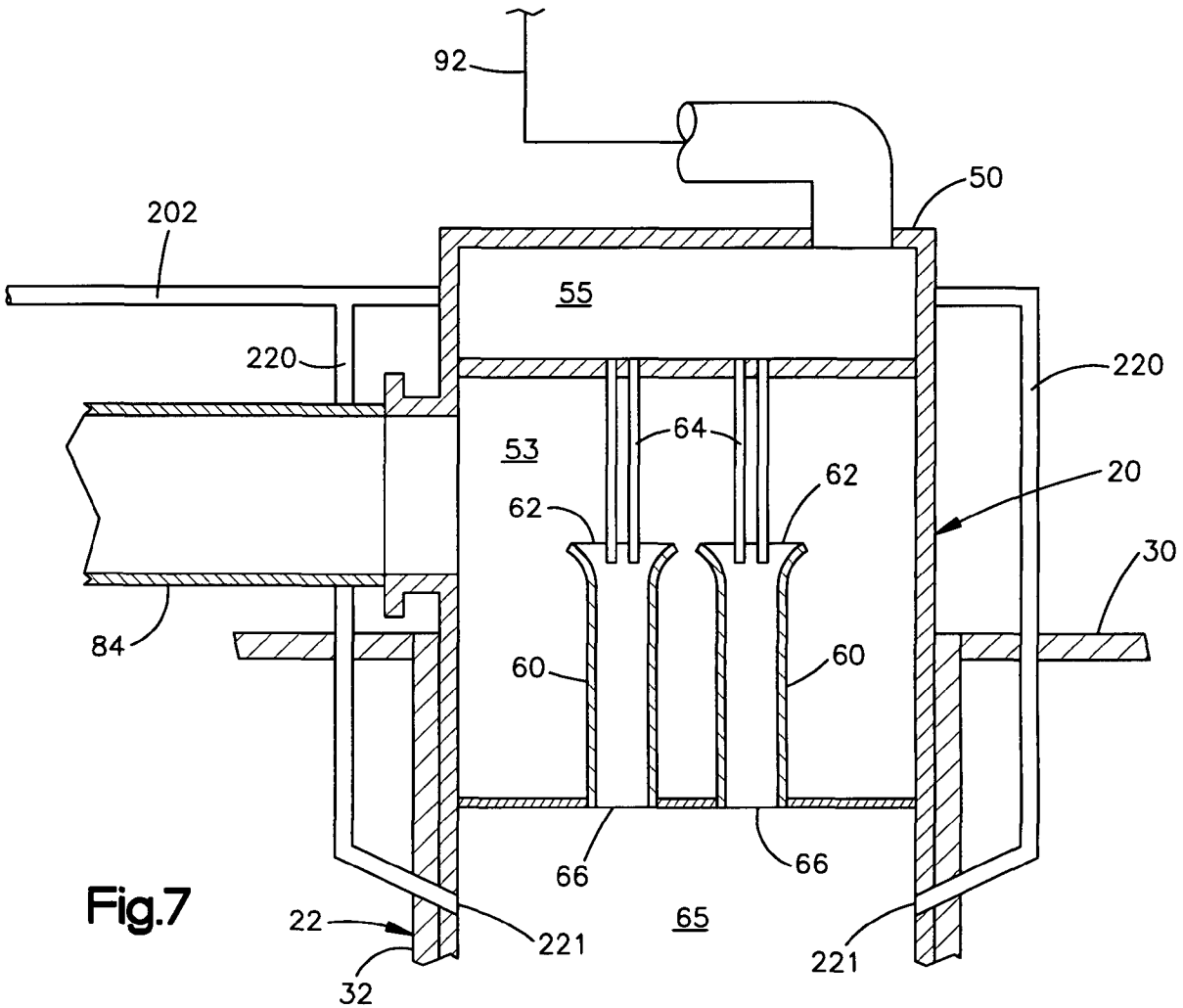
FIGS. 7-10 are schematic views of alternative water injection systems for the SCV of FIG. 1.

In the alternative arrangement shown in FIG. 7, the water line 202 communicates the source 204 with branch lines 220 instead of a manifold. The branch lines 220 terminate at ports 221 from which streams of water are injected directly into the duct 32 downstream of the burner 20 instead of the duct 84 upstream of the burner 20. Specifically, the ports 221 in the illustrated example are arranged to inject streams of water directly into the reaction zone 65 closely adjacent to the open outer ends 66 of the mixer tubes 60.

Figure 8:
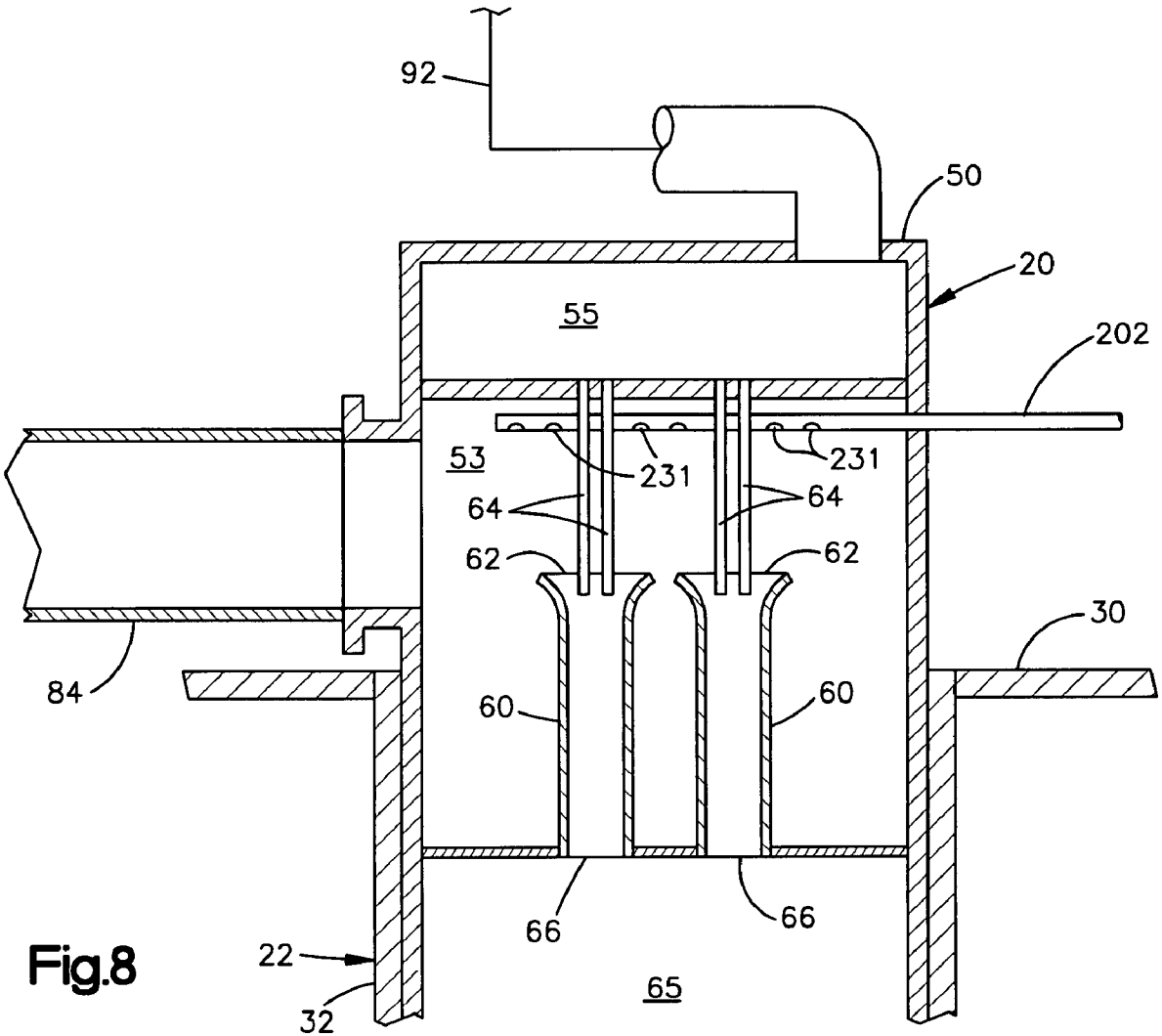
Figure 9:
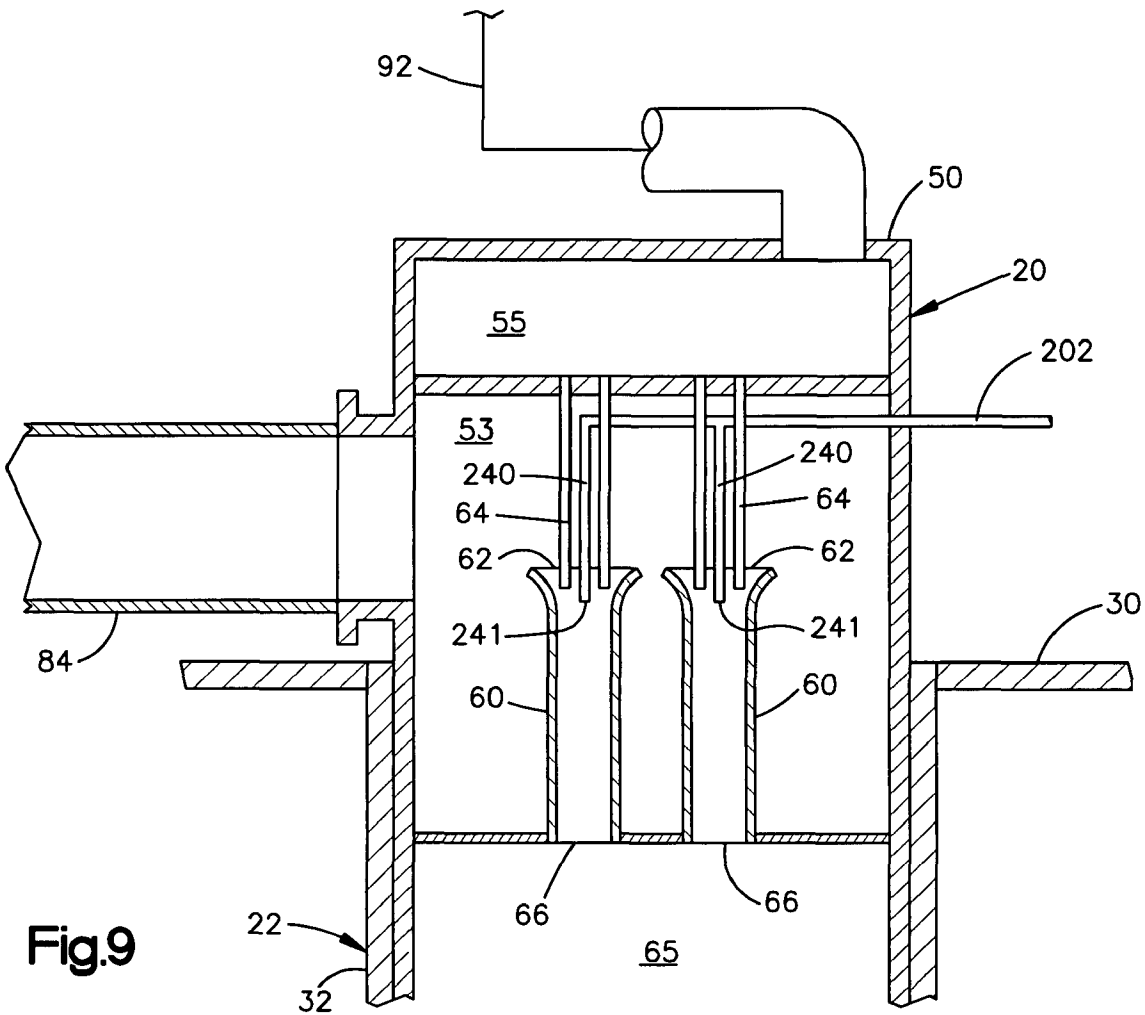
Figure 10:
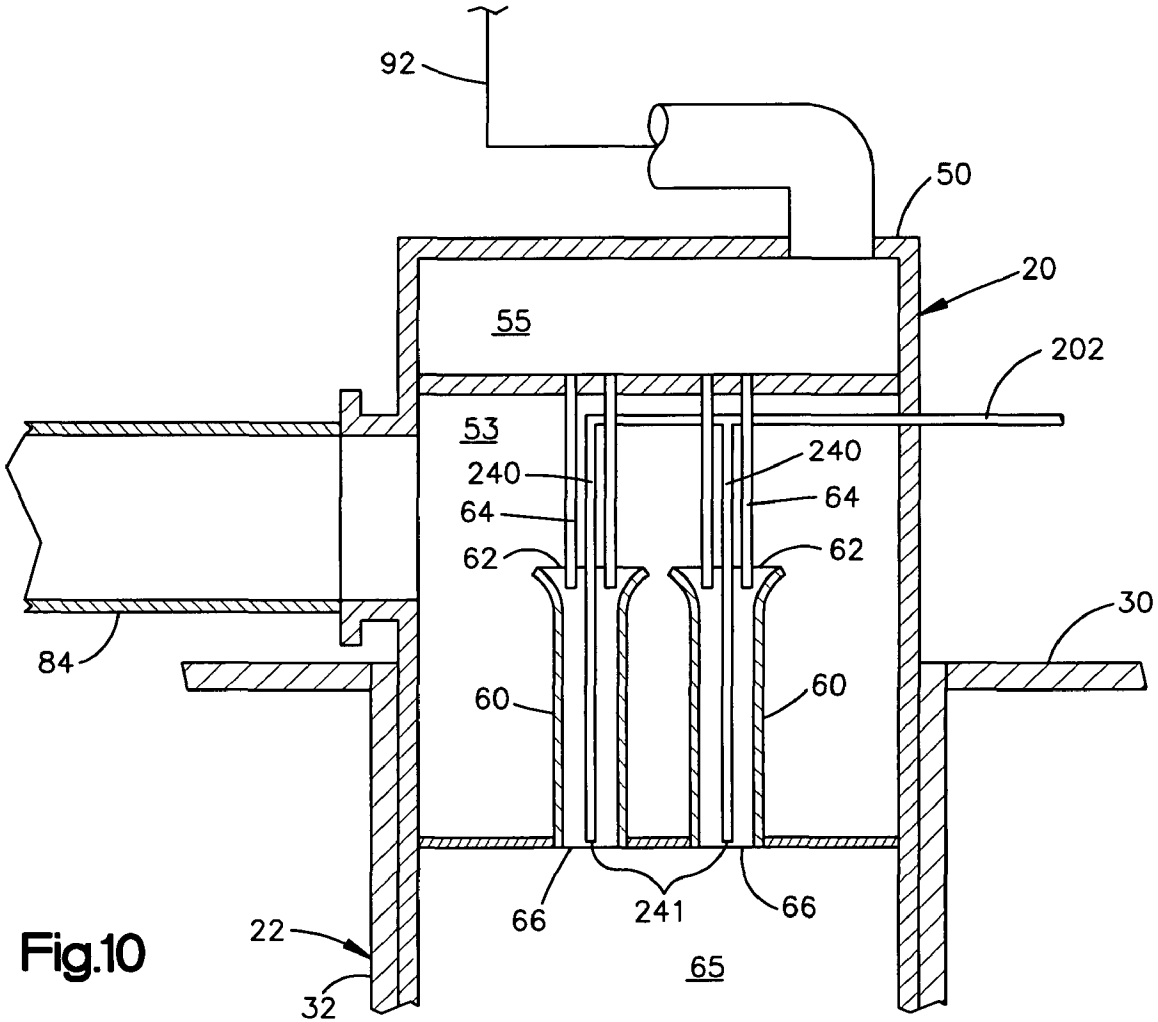

Additional alternative arrangements for the water injection system 200 are shown in FIGS. 8-10. Each of these is configured to inject water into the oxidant flow path within the burner 20. In the arrangement of FIG. 8, the water line 202 extends into the oxidant plenum 53, and has ports 231 for directing streams of water directly into the plenum 53. In the arrangement of FIG. 9, branch lines 240 have ports 241 located within the mixer tubes 60 to direct streams of water directly into the mixer tubes 60. As shown in FIG. 9, the ports 241 are located closer to the inner ends 62 of the tubes 60, but could be located closer to the outer ends 66, as shown for example in FIG. 10, or at other locations within the tubes 60.

Figure 11:
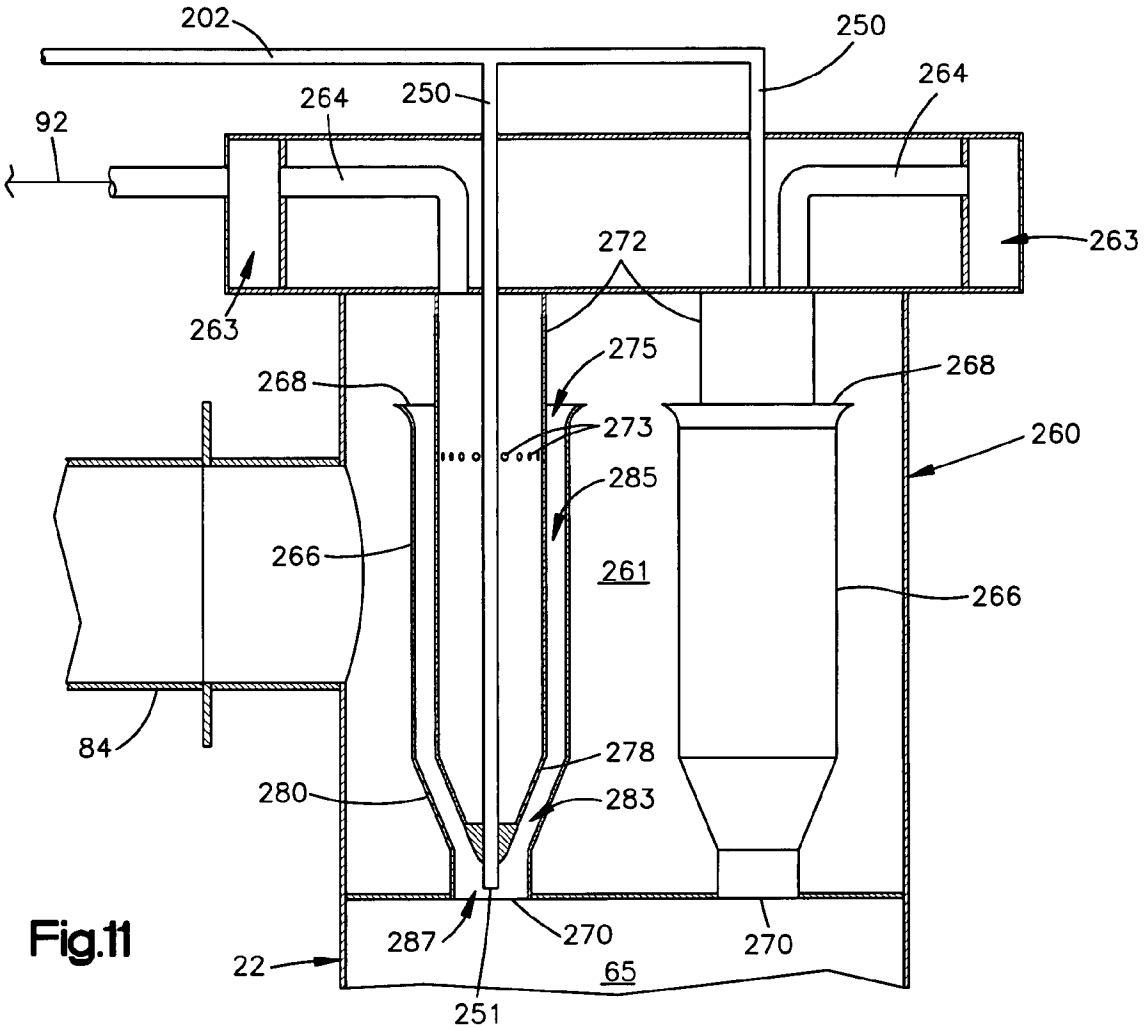
FIG. 11 is a schematic view of a water injection system for an alternative burner in the SCV of FIG. 1.

Another arrangement of branch lines 250 with water injection ports 251 is shown with an alternative burner 260 in FIG. 11. Like the burner 20 described above, the alternative burner 260 has an oxidant plenum 261 that receives oxidant from the blower 82 through the duct 84, and has a fuel plenum 263 that receives fuel from the primary branch line 92. The fuel plenum 263 has an annular configuration surrounding an array of intermediate fuel conduits 264 that extend radially inward. The alternative burner 260 further has mixer tubes 266. Inner ends 268 of the mixer tubes 266 are open within the oxidant plenum 261. Outer ends 270 of the mixer tubes 266 are open into the reaction zone 65 in the duct system 22.

The mixer tubes 266 in the burner 260 of FIG. 11 are wider than the mixer tubes 60 in the burner 20 of FIG. 1. The fuel conduits 272 that extend into the mixer tubes 266 are likewise wider than their counterparts 60 in the burner 20 of FIG. 1.

Each fuel conduit 272 has a circumferentially extending row of ports 273 for discharging fuel streams into the gas flow space 275 between the conduit 272 and the surrounding mixer tube 266. Each fuel conduit 272 further has a generally conical end portion 278 within a section 280 of the mixer tube 266 that tapers radially inward. This provides the gas flow space 275 with a funnel section 283. The flow area of the funnel section 283 preferably decreases along its length in the downstream direction.

Another annular section 285 of the gas flow space 275 is located upstream of the funnel section 283. A short cylindrical section 287 of the gas flow space 275 extends from the funnel section 283 to the premix port defined by the open outer end 270 of the mixer tube 266. The radially tapered configuration of the funnel section 283 enables the upstream section 285 of the gas flow space 275 to extend radially outward of the premix port 270 with a narrow annular shape. That shape promotes more uniform mixing of the fuel and oxidant flowing through the mixer tube 266 without a correspondingly greater length.

This written description sets forth the best mode of carrying out the invention, and describes the invention so as to enable a person of ordinary skill in the art to make and use the invention, by presenting examples of the elements recited in the claims. The patentable scope of the invention is defined by the claims, and may include other examples that occur to those skilled in the art. Such other examples, which may be available either before or after the application filing date, are intended to be within the scope of the claims if they have structural or method elements that do not differ from the literal language of the claims, or if they have equivalent structural or method elements with insubstantial differences from the literal language of the claims.

The invention claimed is:

1. An apparatus comprising:

heat exchanger tubing;

a tank structure configured to contain a water bath for the heat exchanger tubing;

a burner;

a duct system that includes sparger tubes with outlet ports and is configured to convey exhaust from the burner to the sparger tubes; and a fuel delivery system configured to provide the burner with primary fuel, and including a staged fuel injector structure configured to inject a staged fuel stream into the exhaust in the duct system separately from the primary fuel at a location downstream of the burner.

2. An apparatus as defined in claim 1 wherein the staged fuel injector structure is configured to inject a staged fuel stream into the duct system at a location upstream of the sparger tubes.

3. An apparatus as defined in claim 1 wherein the staged fuel injector structure is configured to inject multiple staged fuel streams into the duct system at locations upstream of the sparger tubes.

4. An apparatus as defined in claim 1 wherein the staged fuel injector structure is configured to inject staged fuel streams directly into the sparger tubes.

5. An apparatus as defined in claim 4 wherein the staged fuel injector structure is configured to inject a single staged fuel stream directly into each sparger tube at a location upstream of the outlet ports in the sparger tube.

6. An apparatus as defined in claim 4 wherein the staged fuel injector structure is configured to inject staged fuel streams directly into each sparger tube at locations adjacent to the outlet ports in the sparger tube.

7. An apparatus as defined in claim 1 wherein the fuel delivery system includes fuel lines and valves arranged to deliver fuel from a common source to both the burner and the staged fuel injector structure, whereby the primary fuel and the staged fuel stream include the same fuel from the common source.

8. An apparatus as defined in claim 1 wherein the fuel delivery system is configured to provide the staged fuel injector structure with only fuel.

9. An apparatus as defined in claim 1 wherein the fuel from the common source is natural gas.

10. An apparatus for use with heat exchanger tubing, a tank structure configured to contain a water bath for the heat exchanger tubing, a burner configured to receive primary fuel, and a duct system that includes sparger tubes with outlet ports and is configured to convey exhaust from the burner to the sparger tubes, the apparatus comprising:

a staged fuel injector structure configured to inject a staged fuel stream into the exhaust in the duct system separately from the primary fuel at a location downstream of the burner; and a fuel delivery system including fuel lines and valves arranged to deliver fuel from a common source to both the burner and the staged fuel injector structure, whereby the primary fuel and the staged fuel stream include the same fuel from the common source.

11. An apparatus as defined in claim 10 wherein the staged fuel injector structure is configured to inject a staged fuel stream into the duct system at a location upstream of the sparger tubes.

12. An apparatus as defined in claim 10 wherein the staged fuel injector structure is configured to inject multiple staged fuel streams into the duct system at locations upstream of the sparger tubes.

13. An apparatus as defined in claim 10 wherein the staged fuel injector structure is configured to inject staged fuel streams directly into the sparger tubes.

14. An apparatus as defined in claim 13 wherein the staged fuel injector structure is configured to inject a single staged fuel stream into each sparger tube at a location upstream of the outlet ports in the sparger tube.

15. An apparatus as defined in claim 13 wherein the staged fuel injector structure is configured to inject staged fuel streams into each sparger tube at locations adjacent to the outlet ports in the sparger tube.

16. An apparatus as defined in claim 10 further comprising a fuel delivery system configured to provide the staged fuel injector structure with only fuel.

17. An apparatus as defined in claim 10 wherein the the fuel is natural gas.

18. An apparatus comprising:

heat exchanger tubing;

a tank structure configured to contain a water bath for the heat exchanger tubing;

a duct system including sparger tubes with outlet ports arranged to discharge gas into a water bath in the tank structure;

a premix burner including an oxidant plenum, mixer tubes with open inner ends in the oxidant plenum, and fuel conduits configured to direct fuel into the mixer tubes, with the mixer tubes having open outer ends arranged to discharge premix into the duct system; and a water injection system operatively associated with the premix burner to mix water into the premix;

wherein the oxidant plenum is part of an oxidant flow path extending from a blower to the oxidant plenum and the mixer tubes, and the water injection system is configured to inject water into the oxidant flow path; and wherein the water injection system is configured to inject water into the oxidant flow path upstream of the oxidant plenum.

19. An apparatus comprising:

heat exchanger tubing;

a tank structure configured to contain a water bath for the heat exchanger tubing;

a duct system including sparger tubes with outlet ports arranged to discharge gas into a water bath in the tank structure;

a premix burner including an oxidant plenum, mixer tubes with open inner ends in the oxidant plenum, and fuel conduits configured to direct fuel into the mixer tubes, with the mixer tubes having open outer ends arranged to discharge premix into the duct system; and a water injection system operatively associated with the premix burner to mix water into the premix;

wherein the oxidant plenum is part of an oxidant flow path extending from a blower to the oxidant plenum and the mixer tubes, and the water injection system is configured to inject water into the oxidant flow path; and wherein the water injection system is configured to inject water directly into the oxidant plenum.

* * * * *